US007198520B1

(12) United States Patent
Sivertsen

(10) Patent No.: US 7,198,520 B1
(45) Date of Patent: Apr. 3, 2007

(54) IN-LINE REMOTE CONTROLLABLE POWER SWITCH

(75) Inventor: Clas G. Sivertsen, Lilburn, GA (US)

(73) Assignee: American Megatrends, Inc., Norcross, GA (US)

( * ) Notice: Subject to any disclaimer, the term of this patent is extended or adjusted under 35 U.S.C. 154(b) by 80 days.

(21) Appl. No.: 10/780,795

(22) Filed: Feb. 18, 2004

Related U.S. Application Data

(63) Continuation-in-part of application No. 10/342,501, filed on Jan. 15, 2003, now Pat. No. 6,875,059.

(51) Int. Cl.
*H01R 25/00* (2006.01)

(52) U.S. Cl. ..... 439/638

(58) Field of Classification Search ..... 439/638, 439/650, 620, 502; 307/112, 66, 119, 72, 307/137; 363/143, 147, 141; 320/134
See application file for complete search history.

(56) References Cited

U.S. PATENT DOCUMENTS 5,563,782 A * 10/1996 Chen et al. ..... 363/146
5,732,212 A 3/1998 Perholtz et al. ..... 395/200.11
5,907,197 A * 5/1999 Faulk ..... 307/119
5,910,750 A * 6/1999 Harada et al. ..... 327/544
5,961,619 A * 10/1999 Voloshin ..... 710/300
6,057,610 A 5/2000 Nierescher ..... 307/72
6,160,728 A * 12/2000 Peterson et al. ..... 363/146
6,304,895 B1 10/2001 Schneider et al. ..... 709/203
6,362,610 B1 * 3/2002 Yang ..... 323/281
6,465,913 B1 10/2002 Nagai et al. ..... 307/85
6,628,535 B1 * 9/2003 Wu ..... 363/146
6,664,758 B2 * 12/2003 Yang ..... 320/107
2003/0103304 A1 * 6/2003 Rendic ..... 361/90

* cited by examiner

*Primary Examiner*—Alexander Gilman
(74) *Attorney, Agent, or Firm*—Hope Baldauff Hartman, LLC

(57) ABSTRACT

An apparatus for powering one or more devices is provided. The apparatus includes a housing that has a power input connector that directly receives a power cord and a power output connector connected in series to the power input connector. The housing also contains a power supply connected in parallel to the power input connector. The power supply can generate power for delivery to a second powered device, such as a remote server management device. A cable assembly may extend from the housing for delivering power to the second powered device. The housing may also store a control circuit for controlling the flow of current between the power input connector and the power output connector. The control circuit receives an input signal and, based on the input signal, allows or prevents the flow of current to the integrated power output connector.

23 Claims, 11 Drawing Sheets

IN-LINE REMOTE CONTROLLABLE POWER SWITCH

RELATED APPLICATIONS

The present application is a continuation-in-part of U.S. patent application Ser. No. 10/342,501, filed on Jan. 15, 2003, now U.S. Pat. No. 6,875,059 and entitled IN-LINE REMOTE CONTROLLABLE POWER SWITCH WITH INTEGRATED POWER SUPPLY.

TECHNICAL FIELD

The present invention generally relates to the field of power supply devices and, more particularly, to the field of remote controlled power switches.

BACKGROUND OF THE INVENTION

Modern installations of server computers typically utilize a multitude of separate server computers installed in racks. Each rack may contain twenty or more separate server computers. Each server computer requires its own power cord to operate. Moreover, depending on the configuration, each server computer may require the use of several external powered devices to operate. For instance, a powered keyboard-video-mouse ("KVM") switch or other type of external device may be utilized within a server installation. Because many types of external devices require a power pack, such as a standard wall adapter, the number of power packs and power cords may quickly become unmanageable. This is also true for desktop computers which typically utilize an even greater number of external powered devices, such as universal serial bus ("USB") hubs, printers, external drive enclosures, and other types of devices.

One type of device that is commonly used in server installations is a remote server management device. Remote server management devices allow an administrator to remotely monitor and operate one or more server computers. Remote server management devices are either external or internal devices, and typically require the use of an external power pack. By issuing commands to a remote server management device, a server computer can be turned on, off, or rebooted. However, current server management devices suffer from several drawbacks that reduce their effectiveness with respect to controlling the power functions of a server computer. In particular, if the server computer is in a hung state, the server management device will be unable to shut down the operation of the server computer. Moreover, in order to allow the remote server management device to control the power functions of a server computer, a user typically has to make internal connections between the server computer and the management device. These connections can be difficult for a typical user to make without the assistance of a technician.

It is with respect to these considerations and others that the present invention has been made.

SUMMARY OF THE INVENTION

In accordance with the present invention, the above and other problems are solved by the present invention. In particular, the present invention reduces the amount of clutter caused by external powered devices used in conjunction with a computer system. Moreover, the present invention allows a remote server management device to control the power functions of one or more server computers even when in a locked state and without the need for special connections.

In accordance with other aspects, the present invention relates to an apparatus for powering one or more devices. The apparatus includes a housing that has a power input connector that directly receives a power cord, such as a standard power cord utilized by a computer system. The housing also has either a power output connector or a power output cord connected in series to the power input connector. The power output connector, or connector of the power output cord, may also be configured as a standard power connector, such as those utilized by typical computers. In this manner, a power cord can be plugged directly into the housing and the housing can be plugged directly into a computer or other type of powered device either by plugging in the integrated power output connector or plugging in the power output cord.

The housing also contains a power supply connected in parallel to the power input connector. In one configuration, the power supply can generate power for delivery to a second powered device, such as a remote server management device. A cable assembly may extend from the housing for delivering power to the second powered device. The power supply is typically configured for generating direct current. Alternatively, the power supply may generate only power for a control circuit that serves to control application of power to the integrated power output connector or cord. Moreover, the housing may also hold one or more externally mounted switches for controlling the flow of current to the power supply or to the power output connector.

In accordance with still other aspects, the present invention relates to an apparatus for remotely controlling a power switch. In particular, an apparatus is provided that includes a housing having an integrated power input connector and a connected power output connector and/or cord. The housing also stores a power supply for providing power to a second powered device, or alternatively only providing power to a control circuit. Additionally, the housing stores the control circuit receiving power from the power supply for controlling the flow of current between the power input connector and the power output connector. The control circuit receives an input signal and, based on the input signal, allows or prevents the flow of current to the power output connector and/or cord.

The input signal to the control circuit may be provided along a cable assembly extending from the housing. The cable assembly may then be connected to a remote server management device or other type of powered device. The input signal may then be modified by the device to shut down the operation of the powered device connected to the power output connector and/or cord. A parallel bus connector may also be mounted on the external surface of the housing to expose the input signal to other devices. In this manner, a single remote server management device or other type of powered device may shut down multiple powered devices through a single connection.

These and various other features as well as advantages, which characterize the present invention, will be apparent from a reading of the following detailed description and a review of the associated drawings.

DETAILED DESCRIPTION OF THE INVENTION

Turning now to the drawings, in which like numerals represent like elements, various embodiments of the present invention will be described. It should be appreciated that the various embodiments of the invention are merely illustrative and that changes can be made without departing from the spirit and scope of the invention.

Figure 1B:
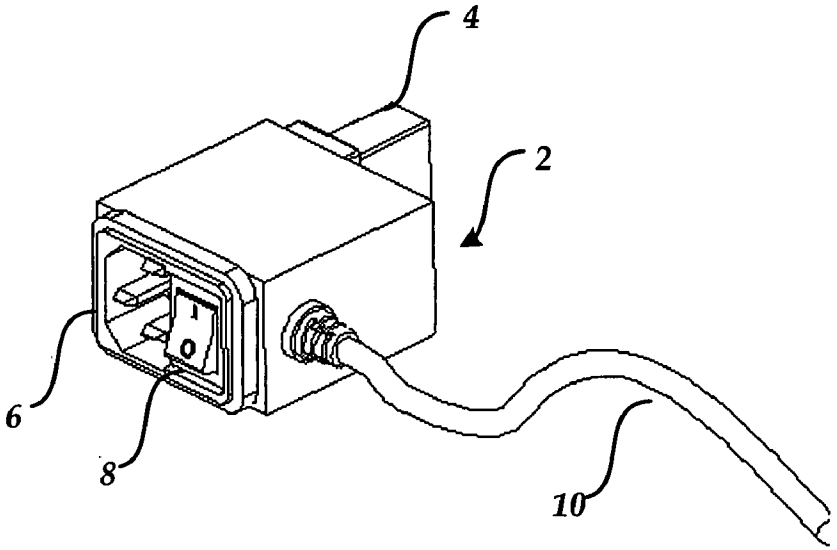
FIGS. 1A and 1B are perspective diagrams illustrating a device provided in one embodiment of the present invention.
Figure 1A:
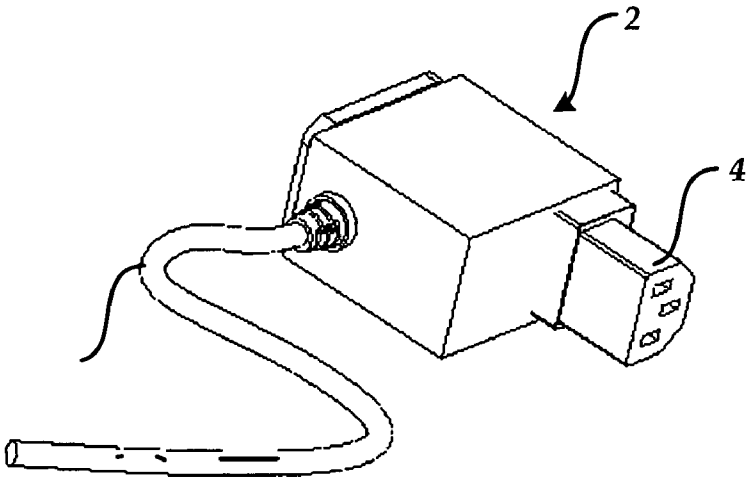

Referring now to FIGS. 1A and 1B, various aspects of one embodiment of the invention will be described. As discussed briefly above, embodiments of the invention provide a remote controllable power switch with an integrated power supply. According to one embodiment, the apparatus comprises a housing 2. The housing 2 is created from mold injected plastic or other type of suitable non-conducting material. The housing 2 includes an integrated power input connector 6 (also referred to as the "input connector" herein). The integrated power input connector 6 is operative to directly receive a power cord. In particular, according to one embodiment of the invention, the integrated power input connector 6 comprises an International Electrotechnical Commission ("IEC) IEC-320/C14 connector. It should also be appreciated that other types of connectors suitable for receiving a power cord may also be utilized.

As shown in FIGS. 1A and 1B, the housing 2 also comprises an integrated power output connector 4 (also referred to herein as the "output connector"). The integrated power output connector 4 is mounted directly to the housing 2 and is configured in a manner that allows the integrated power output connector 4 to be mated directly with a compatible input connector. In particular, according to one embodiment of the invention, the integrated power output connector 4 comprises an IEC-320/C13 connector that may be mated with an IEC-320/C14 connector utilized on many computer power supplies. In this manner, a power cord may be plugged directly into the integrated power input connector 6 and the integrated power output connector 4 may be plugged directly into the power receptacle of a powered device. It should be appreciated that other types of connectors may be utilized for the integrated power output connector 4.

As will be described in greater detail below, the integrated power input connector 6 and the integrated power output connector 4 are electrically connected in series, thereby allowing electrical current applied at the integrated power input connector 6 to be passed directly through to the integrated power output connector 4. As will also be discussed in greater detail below, a switch 8 may be mounted on and accessible from an external surface of the housing 2 and interposed between the integrated power input connector 6 and the integrated power output connector 4. In this manner, the flow of electrical current between the integrated power input connector 6 and the integrated power output connector 4 may be controlled through the use of the switch 8.

As will also be described in greater detail below, according to various embodiments of the invention, the housing 2 may also contain a power supply for powering an external powered device other than the device connected to the integrated power output connector 4. Power may be generated and delivered to the powered device through a cable assembly 10 extending from the housing 2. For instance, the power supply may be utilized to provide power to a remote server management device, a USB hub, or other type of device. According to various embodiments of the invention, the switch 8 may be utilized to control the operation of the power supply. Additional details regarding the various embodiments of the invention will be provided below with respect to FIGS. 2–7.

Figure 2:
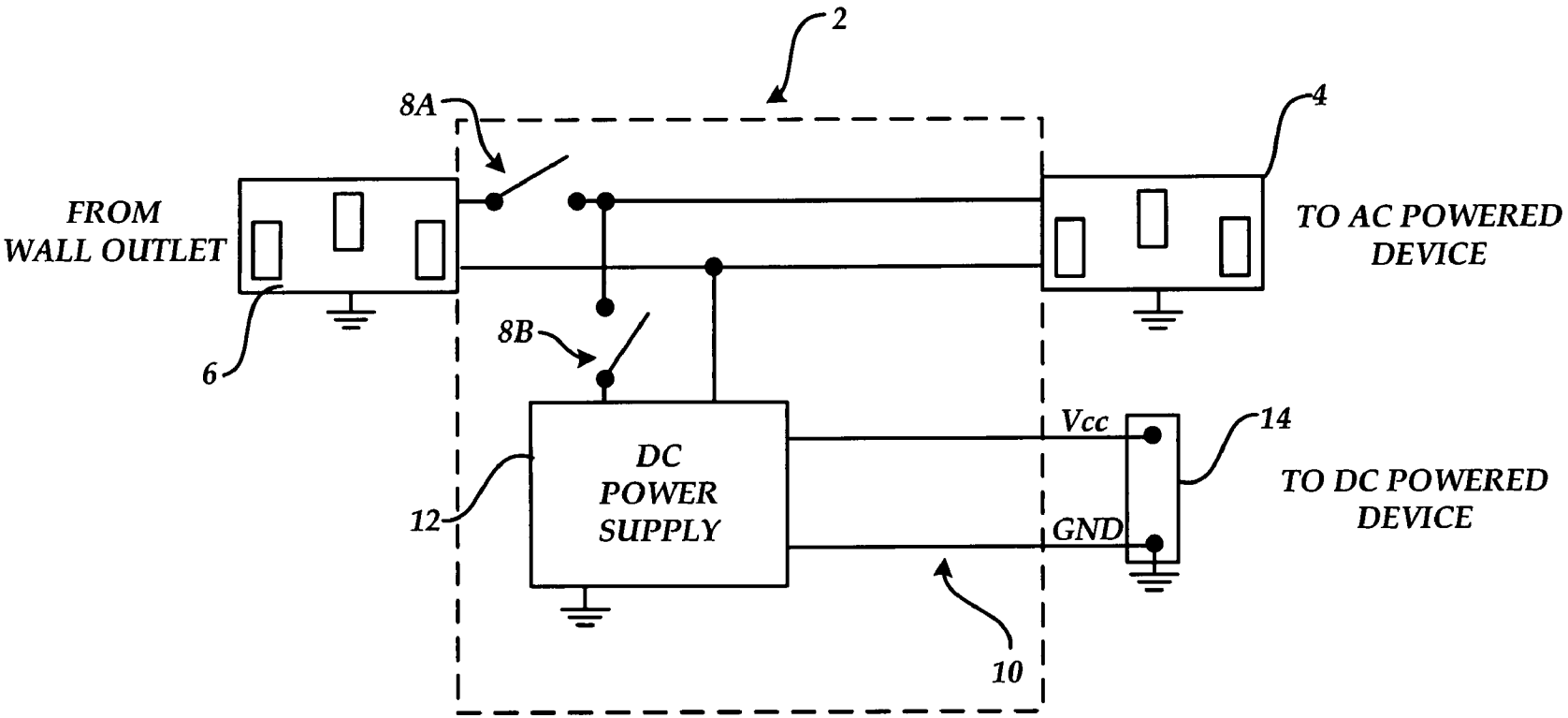
FIG. 2 is a circuit diagram illustrating aspects of one embodiment of the invention.

Referring now to FIG. 2, a circuit diagram will be described that illustrates a circuit for implementing one embodiment of the invention. As discussed briefly above, according to this embodiment of the invention, the housing 2 includes an integrated power input connector 6 and an integrated power output connector 4. The integrated power input connector 6 directly receives a power cord. The input connectors on the integrated power input connector 6 are connected in series to the appropriate connectors on the integrated power output connector 4, thereby passing alternating electrical current ("AC") applied at the input connector 6 to the output connector 4. In this manner, an AC powered device, such as the power supply of a computer system, may be directly powered by mating the power output connector 4 to the appropriate connector of the power supply.

As also described briefly above, according to one embodiment, a switch 8A may be interposed between the input connector 6 and the output connector 4, thereby preventing the flow of current between the input connector 6 and the output connector 4 when in an open position. The switch 8A may be mounted on and accessible from an external portion of the housing 2. By using the switch 8A, a user may easily remove power from the integrated power output connector 4.

According to another embodiment of the invention, the housing 2 may be utilized to store a power supply 12. In particular, according to one embodiment of the invention, the power supply 12 may comprise a direct current ("DC") power supply operative to generated power for powering an external device. The power supply 12 may be connected in parallel to the integrated power input connector 6. The output of the power supply 12 may be supplied external to the housing 2 through a connected cable assembly 10. The cable assembly and a terminating connector 14 compatible for use with a power input connector on a powered device may be utilized to provide power to the powered device.

As also described briefly above, according to one embodiment, a switch 8B may be interposed between the integrated power input connector 6 and the power supply 12, thereby preventing the flow of current between the input connector 6 and the power supply 12 when in an open position. The switch 8B may be mounted on and accessible from an external portion of the housing 2. By using the switch 8B, a user may easily remove supply power from the power supply 12, thereby eliminating the output voltage of the power supply 12. In this manner, the powered device may be conveniently turned on and off.

Figure 3:
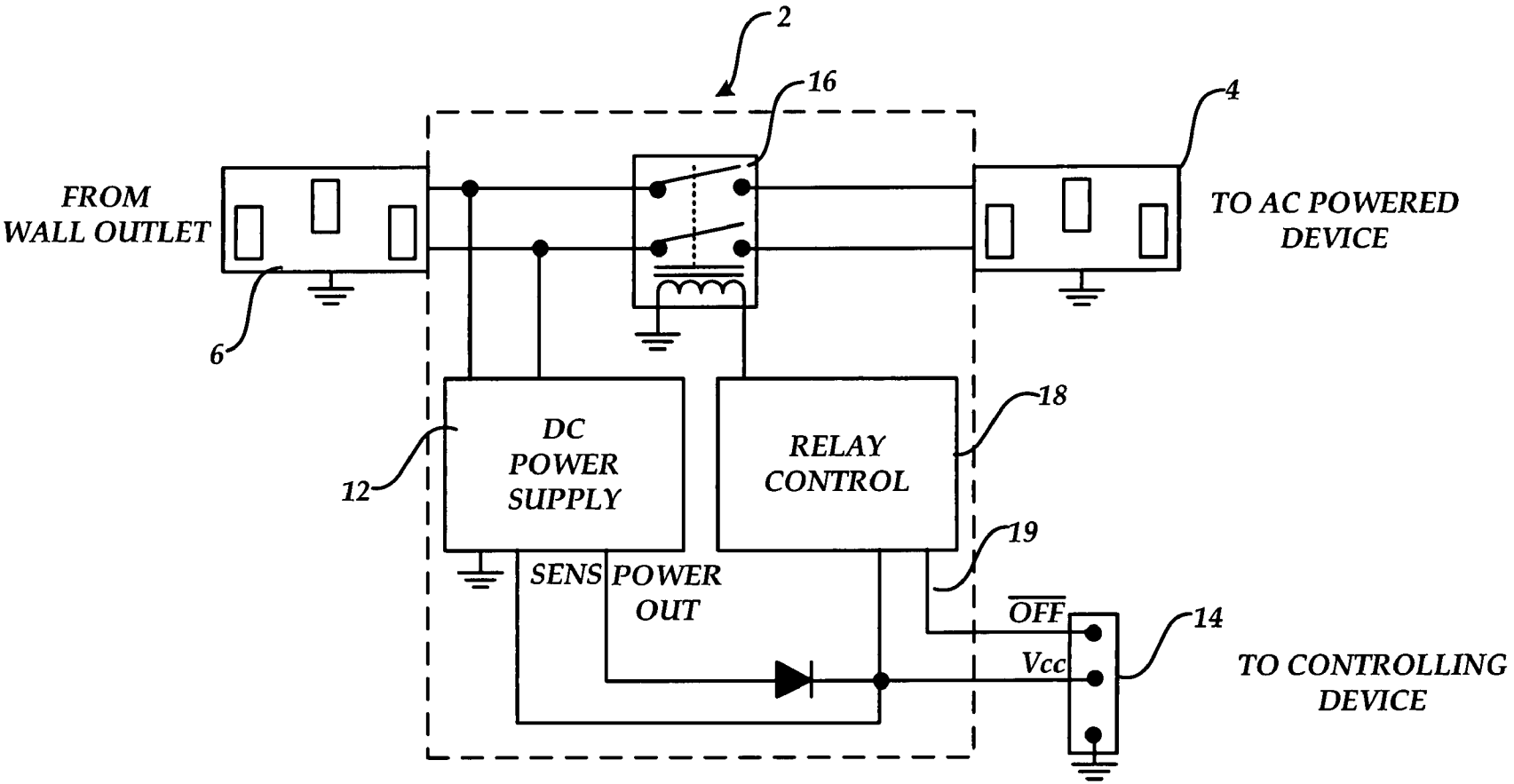
FIG. 3 is a circuit diagram illustrating aspects of another embodiment of the invention.

Referring now to FIG. 3, a circuit diagram will be described that illustrates a circuit for implementing another actual embodiment of the invention. As discussed briefly above, according to this embodiment of the invention, the housing 2 includes an integrated power input connector 6 and an integrated power output connector 4. The input connectors on the integrated power input connector 6 are connected in series to the appropriate connectors on the integrated power output connector 4, thereby passing AC applied at the input connector 6 to the output connector 4. In this manner, an AC powered device, such as the power supply of a computer system, may be directly powered by mating the power output connector 4 to the appropriate connector of the power supply.

According to this embodiment of the invention, the housing 2 may be utilized to store a power supply 12 operative to generated power for powering an external device. The power supply 12 may be connected in parallel to the integrated power input connector 6. The output of the power supply 12 may be supplied external to the housing 2 through a connected cable assembly 10. The cable assembly and a terminating connector 14 compatible for use with a power input connector on a powered device may be utilized to provide power to the powered device.

According to this embodiment of the invention, the housing 2 is also utilized to house a control circuit that receives an input signal and, based on the status of the input signal, either allows or prevents the flow of current between the input connector 6 and the output connector 4. In particular, according to one embodiment of the invention, the housing 2 includes a relay control 18 and a relay 16. The relay 16 is interposed between the input connector 6 and the output connector 4. The relay control 18 comprises a circuit for controlling the operation of the relay 16 based upon the status of an input signal 19. The input signal 19, as well as power generated by the power supply 12, are exposed on the cable assembly and the terminating connector 14. In this manner, the input signal 19 for controlling the operation of the relay 16 are available for control by external devices. Therefore, an external device, such as a remote server management device, may be powered by the power supply 12 and also control the flow of power to the output connector 4. This may be useful, for instance, when it is necessary for the remote server management device to shut down the operation of a server computer by removing power to the output connector 4. Additional details regarding the power supply 12 and the relay control 18 will be provided below with respect to FIGS. 4 and 5, respectively.

Figure 4:
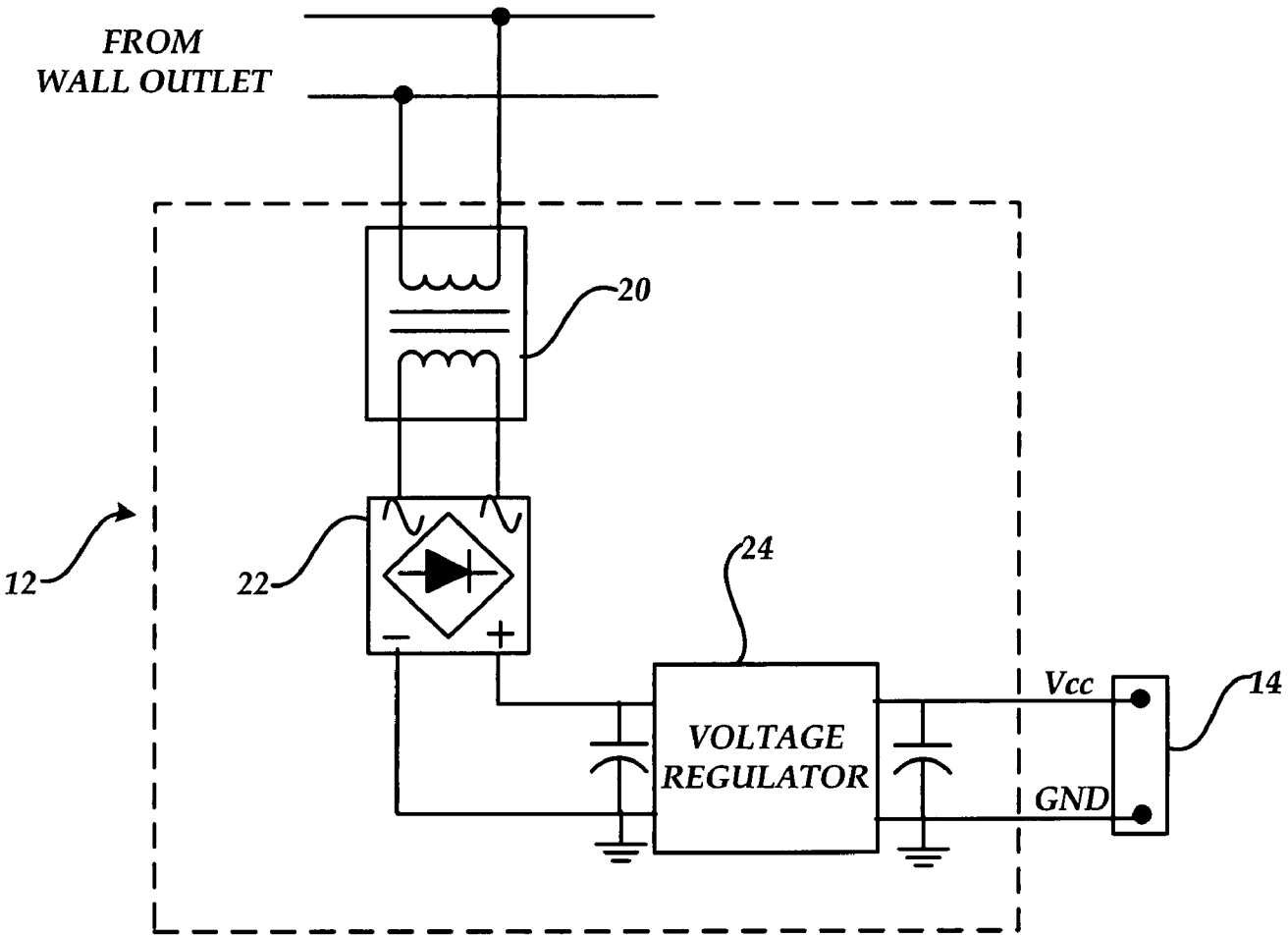
FIG. 4 is a circuit diagram illustrating a power supply utilized in one embodiment of the invention.

Turning now to FIG. 4, an illustrative power supply 12 utilized in one embodiment of the invention will be described. As discussed briefly above, the power supply 12 comprises a DC power supply in one embodiment of the invention. In particular, according to one embodiment of the invention, the power supply 12 comprises a transformer 20 connected in parallel with the input connector 6. The outputs of the transformer 20 are connected in series to a diode rectifier bridge 22. In turn, the outputs of the diode rectifier bridge 22 are connected to a voltage regulator 24. The DC power output of the voltage regulator 24 is then routed outside the housing 2 via the cable assembly 10. As discussed above, the power output terminates at a terminating connector 14 that is compatible with a power input connector on a DC powered device. It should be appreciated that although the power supply described herein is a DC power supply, other types of power supplies may be utilized to power different types of devices. For instance, a universal power supply with a user-selectable voltage may be utilized in conjunction with a variety of differently sized terminating connectors 14. In this manner, the apparatus may be utilized to power a variety of devices having different voltage requirements. Moreover, multiple cable assemblies may be utilized to power several devices concurrently.

Figure 5:
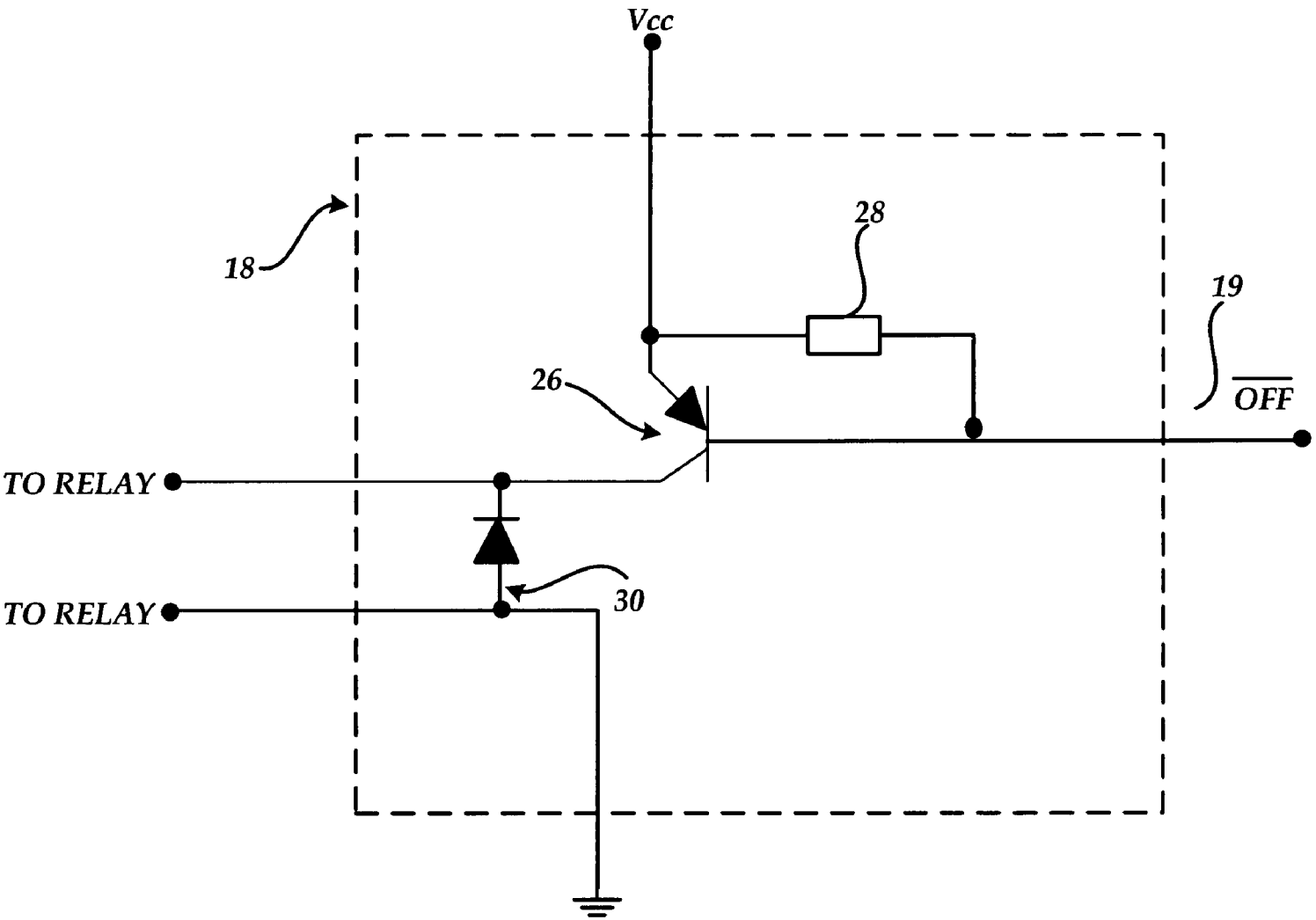
FIG. 5 is a circuit diagram showing an illustrative relay control circuit provided in one embodiment of the invention.

Referring now to FIG. 5, an illustrative circuit for controlling the operation of a relay 16 according to one embodiment of the invention will be described. As discussed briefly above, the relay control 18 provides an input signal 19 that may be utilized by an external device to control the operation of the relay 16 and, consequently, the delivery of power to the output connector 4. More particularly, according to one embodiment of the invention, a PNP transistor 26 is utilized as the basis for the relay control 18. The emitter of the PNP transistor 26 is connected to voltage and the input signal 19 is connected to the base in conjunction with a pull-up resistor 28. It should be appreciated that the input signal 19 is an open collector input. The collector of the PNP transistor 26 is connected to one input of the relay 16. The other input of the relay 16 is connected to ground and a reverse voltage protection diode 30 is interposed between the inputs of the relay 16. In this manner, when the input signal 19 is driven low by an external device, the PNP transistor 26 operates to open the relay 16, thereby eliminating the flow of current between the input connector 6 and the output connector 4. Although the control circuit has been described herein as a relay utilized in conjunction with a PNP transistor-based relay control 18, it should be appreciated that other types of control schemes may be utilized.

Figure 6B:
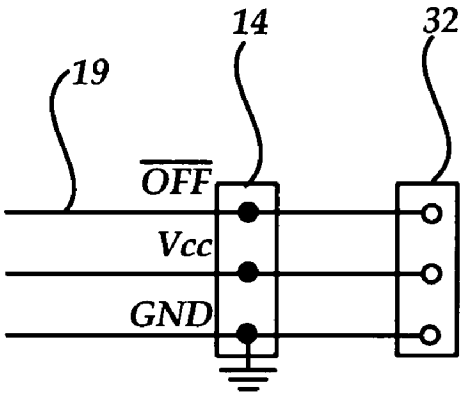
FIG. 6B is a circuit diagram illustrating a daisy chain connector provided by one embodiment of the present invention.
Figure 6A:
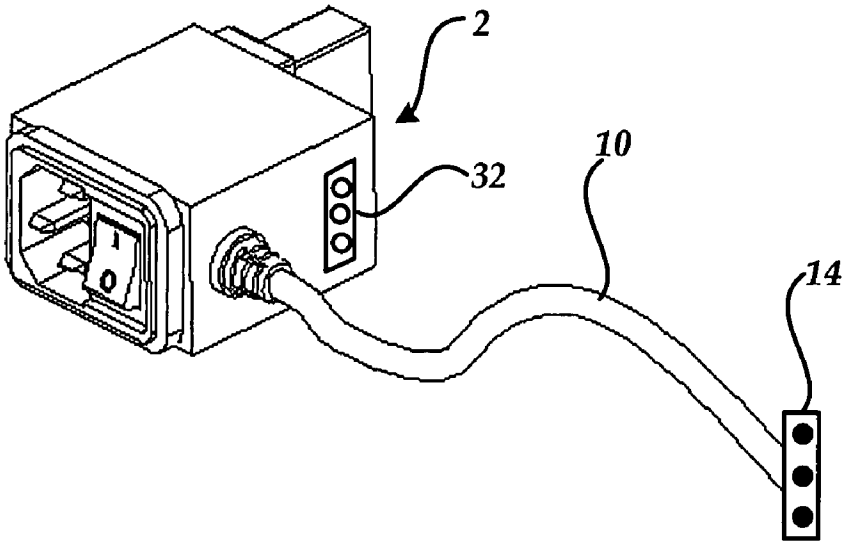
FIG. 6A is a perspective diagram illustrating a cable assembly and connectors utilized by various embodiments of the invention.

Turning now to FIGS. 6A and 6B, a cable assembly and daisy chain connector utilized in various embodiments of the invention will be described. As shown in FIG. 6A and described briefly above, the output of the power supply 12 may be provided to external devices through a cable assembly 10. The cable assembly 10 is terminated with a terminating connector 14 that includes connectors for power and ground. The terminating connector 14 also includes a connector for the input signal 19 for controlling the relay control 18. In this manner, a single cable assembly 10 can be utilized to both power an external device and to expose the input signal 19 necessary for the external device to control the flow of power to the output connector 4.

Figure 7:
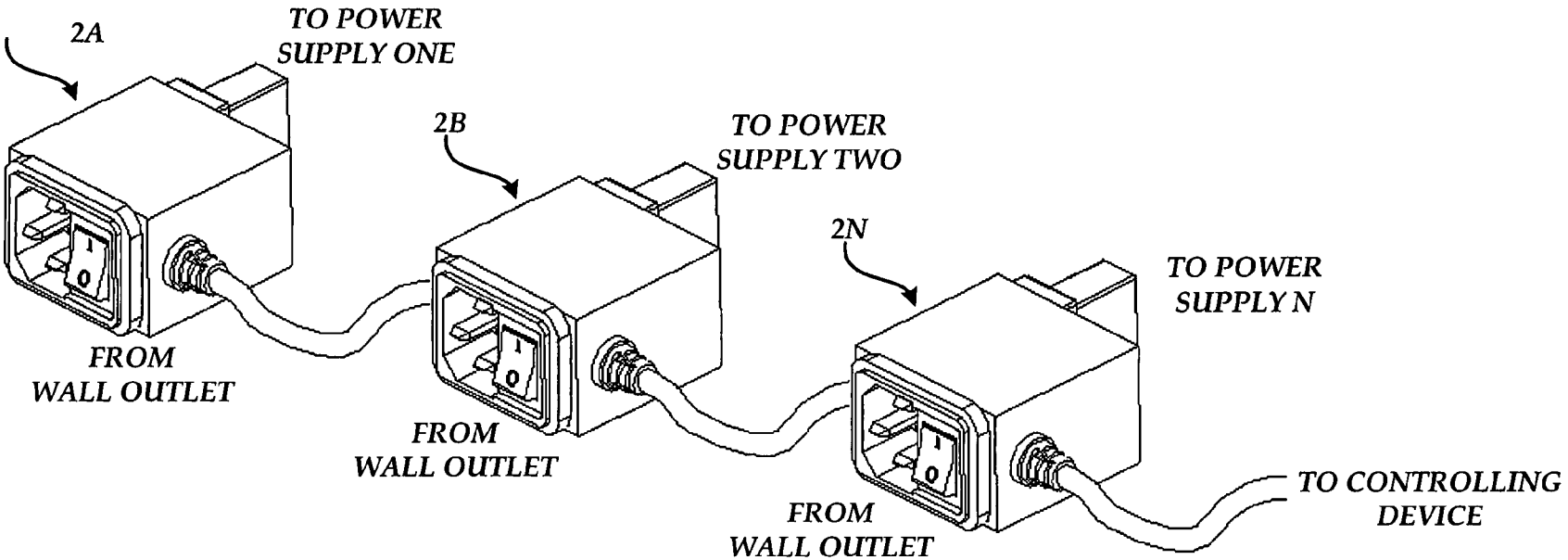
FIG. 7 is a perspective diagram illustrating the use of several devices in a parallel configuration according to one embodiment of the invention.

According to one embodiment of the invention, the housing 2 also includes a daisy chain connector 32. As shown in FIGS. 6A and 6B, the daisy chain connector 32 provides an input connector for ground, power, and the input signal 19. As shown in FIG. 6B, the connectors of the daisy chain connector 32 are connected in parallel to the output connectors of the terminating connector 14, thereby creating a bus. Moreover, the daisy chain connector 32 is compatible with the terminating connector 14. As shown in FIG. 7, multiple devices 2A–2N may be daisy chained together. A single external powered device connected to the daisy chain may then control the power delivered by each of the devices. This may be useful, for instance, when a server computer utilizes multiple power supplies. Moreover, because the power, ground, and input signal 19 are on a bus, the power supply in one device may drive the relay of another device in the event that the power supply in that device fails.

Figure 8B:
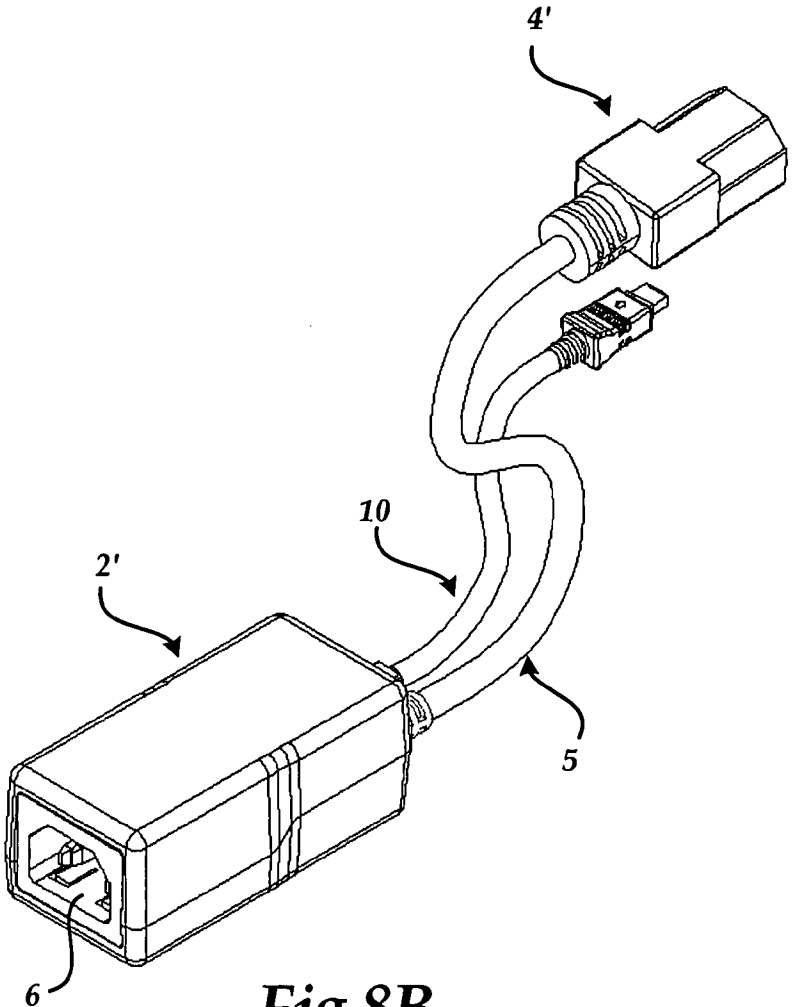
FIGS. 8A and 8B are perspective diagrams illustrating a device provided in one embodiment of the present invention that includes a power cord to be plugged into a receptacle of a powered device rather than plugging in an integrated output power connector directly into the receptacle.
Figure 8A:
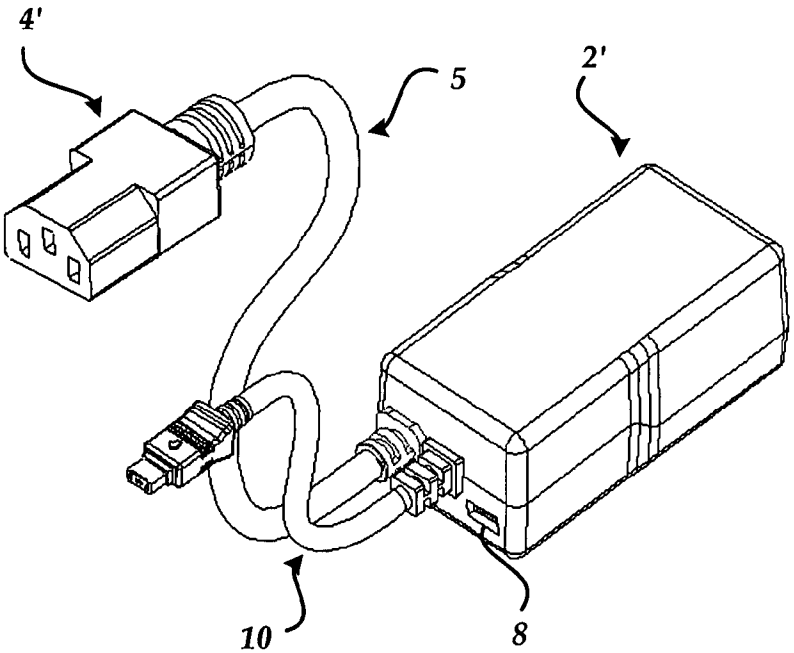

Referring now to FIGS. 8A and 8B, various aspects of another embodiment of the invention will be described. As discussed briefly above, embodiments of the invention provide a remote controllable power switch with an integrated power supply which may supply power to a second powered device, or as discussed below, may provide power only to a control circuit for providing the remote control of the power switch. According to the embodiment of FIGS. 8A and 8B, the apparatus comprises a housing 2'. The housing 2' is created from mold injected plastic or other type of suitable non-conducting material. The housing 2' includes an integrated power input connector 6 such as the integrated power input connector 6 of FIGS. 1A and 1B. The integrated power input connector 6 is operative to directly receive a power cord. In particular, according to this embodiment of the invention, the integrated power input connector 6 comprises an International Electrotechnical Commission ("IEC) IEC-320/C14 connector. It should also be appreciated that other types of connectors suitable for receiving a power cord may also be utilized in this embodiment as well.

As shown in FIGS. 8A and 8B, the housing 2' also comprises a power output cord 5 (also referred to herein as the "output cord"). The power output cord 5 may be mounted directly to the housing 2' either as an integral component extending from the housing 2' as shown in FIGS. 8A and 8B or alternatively as a separate component that plugs into a connector of the housing 2'. For example, the housing 2' may have an IEC-320/C14 for output and the power output cord 5 may have an IEC-320/C13 at one end for plugging into the IEC-320/C14 connector of the housing 2' while having an IEC-320/C13 connector 4' at the other distal end to plug into a receptacle of a powered device. The cord 5 is configured in a manner that allows the power output cord 5 to be mated at its distal end directly with a compatible input connector of a device. In particular, according to one embodiment of the invention, the power output cord 5 comprises the IEC-320/C13 connector 4' on the end of the cord that may be mated with an IEC-320/C14 connector utilized on many computer power supplies. In this manner, a power cord may be plugged directly into the integrated power input connector 6 and the connector 4' of the power output cord 5 may be plugged directly into the power receptacle of a powered device. It should be appreciated that other types of connectors may be utilized for the connector 4' of the power output cord 5.

As will be described in greater detail below, the integrated power input connector 6 and the power output cord 5 are electrically connected in series, thereby allowing electrical current applied at the integrated power input connector 6 to be passed directly through to the power output cord 5. As will also be discussed in greater detail below, a switch 8 may be mounted on and accessible from an external surface of the housing 2' and interposed between the integrated power input connector 6 and the power output cord 5. In this manner, the flow of electrical current between the integrated power input connector 6 and the power output cord 5 may be controlled through the use of the switch 8.

As was described in greater detail above, according to various embodiments of the invention, the housing 2' may also contain a power supply for powering an external powered device other than the device connected to the power output cord 5. Power may be generated and delivered to the powered device through a cable assembly 10 extending from the housing 2'. For instance, the power supply may be utilized to provide power to a remote server management device, a USB hub, or other type of device. According to various embodiments of the invention, the switch 8 may be utilized to control the operation of the power supply.

Figure 9:
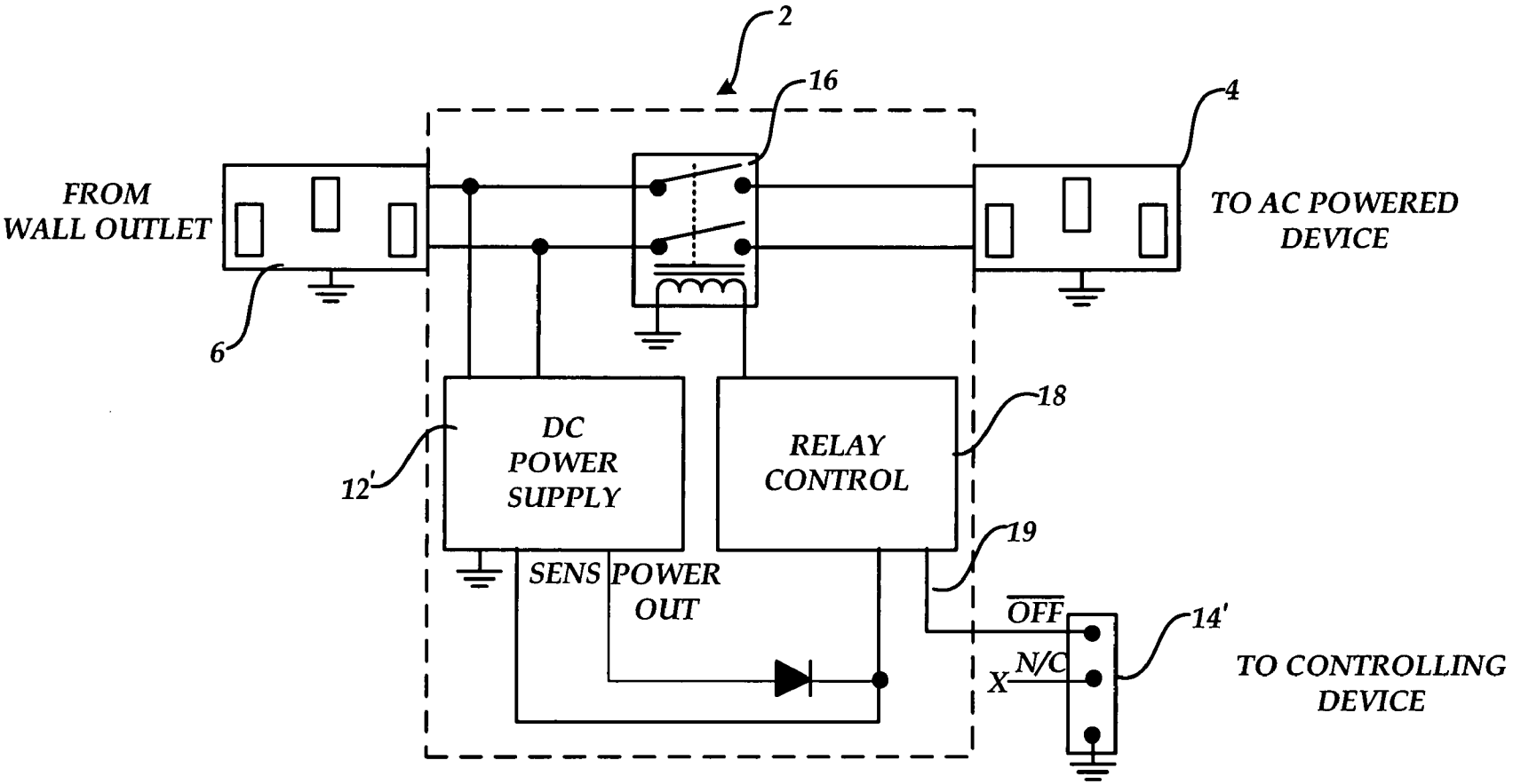
FIG. 9 is a circuit diagram illustrating aspects of another embodiment where power is not supplied to a second powered device.

Referring now to FIG. 9, a circuit diagram will be described that illustrates a circuit for implementing another actual embodiment of the invention. As discussed briefly above, according to this embodiment of the invention, the housing 2 or 2' includes an integrated power input connector 6 and an integrated power output connector 4 or power output cord 5. The input connectors on the integrated power input connector 6 are connected in series to the appropriate connectors on the integrated power output connector 4 or power output cord 5, thereby passing AC applied at the input connector 6 to the output connector 4 or 4'. In this manner, an AC powered device, such as the power supply of a computer system, may be directly powered by mating the power output connector 4 or 4' to the appropriate connector of the power supply.

According to this embodiment of the invention, the housing 2 or 2' may be utilized to store a power supply 12' operative to generate power for powering only the control circuit for a remote controlled switch rather than also providing power to an external device. Often, the external device that provides an input signal to control the remote controlled switch has its own power supply and does not need to be supplied power from the device that the control signal is being provided to. The power supply 12' may be connected in parallel to the integrated power input connector 6. The output of the power supply 12' is not supplied external to the housing 2 through a connected cable assembly 10 in this embodiment. The cable assembly and a terminating connector 14 compatible for use with a power input connector on a powered device is not utilized to provide power to the powered device but instead only carries the input signal and may also carry a ground connection.

According to this embodiment of the invention, the housing 2 or 2' is also utilized to house a control circuit that receives the input signal and, based on the status of the input signal, either allows or prevents the flow of current between the input connector 6 and the output connector 4 or 4'. In particular, according to one embodiment of the invention, the housing 2 or 2' includes a relay control 18 and a relay 16. The relay 16 is interposed between the input connector 6 and the output connector 4 or 4'. The relay control 18 comprises a circuit for controlling the operation of the relay 16 based upon the status of an input signal 19. The input signal 19 is exposed on the cable assembly and the terminating connector 14. In this manner, the input signal 19 for controlling the operation of the relay 16 is available for control by external devices. Therefore, an external device, such as a remote server management device, may control the flow of power to the output connector 4 or 4' even though the external device receives its power from elsewhere. This may be useful, for instance, when it is necessary for the remote server management device to shut down the operation of a server computer by removing power to the output connector 4 or 4'. Additional details regarding the power supply 12' will be provided below with respect to FIG. 10, while the details of the relay control 18 are shown above with reference to FIG. 5.

Figure 10:
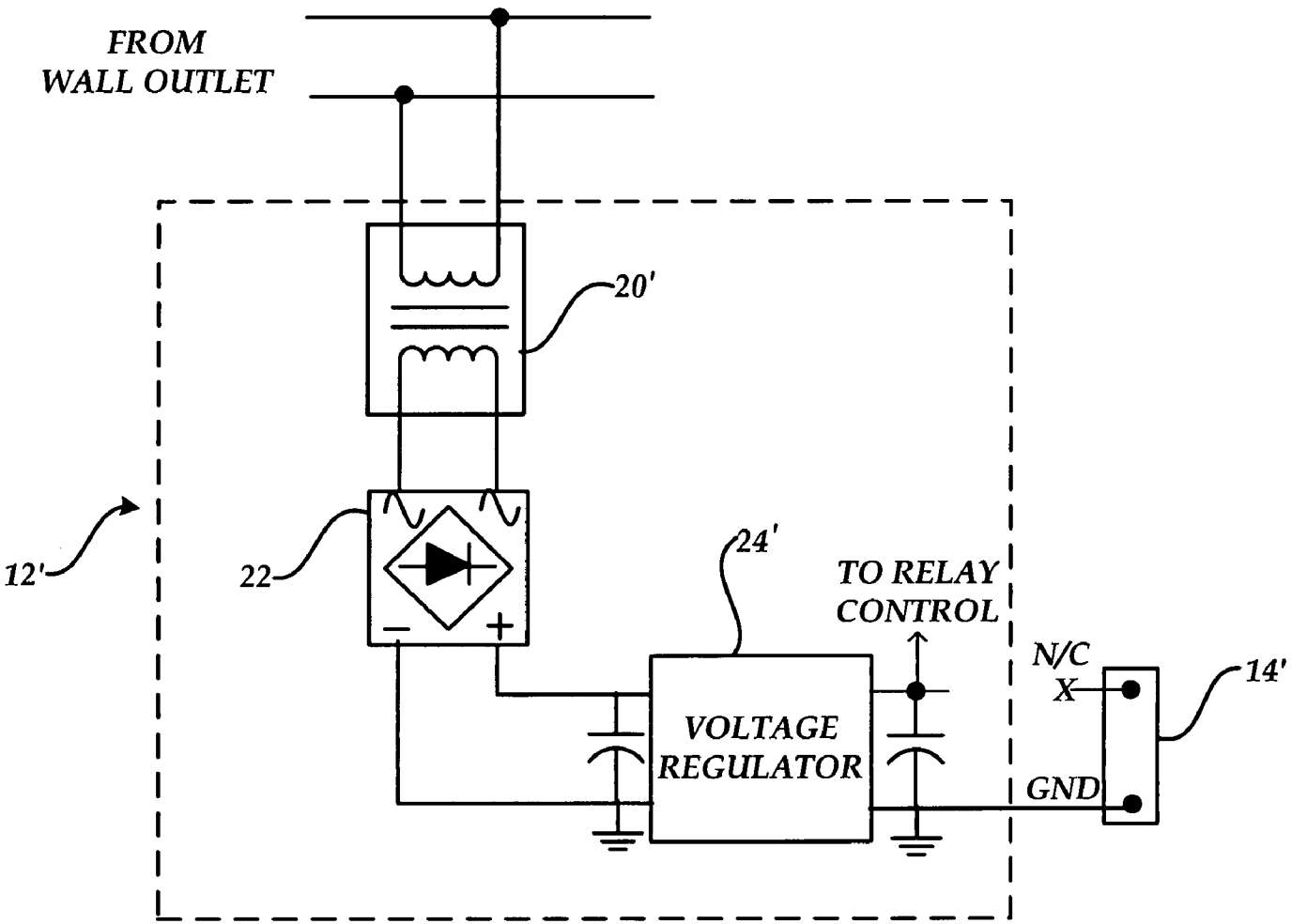
FIG. 10 is a circuit diagram illustrating a power supply utilized in one embodiment of the invention where power is not supplied to a second powered device.

Turning now to FIG. 10, an illustrative power supply 12' utilized in one embodiment of the invention will be described. As discussed briefly above, the power supply 12' comprises a DC power supply in one embodiment of the invention. In particular, according to one embodiment of the invention, the power supply 12' comprises a transformer 20' connected in parallel with the input connector 6. The outputs of the transformer 20' are connected in series to a diode rectifier bridge 22. In turn, the outputs of the diode rectifier bridge 22 are connected to a voltage regulator 24'. The DC power output of the voltage regulator 24' is then routed only to the relay control circuit, rather than outside the housing 2 or 2' via the cable assembly 10.

Because the power supply 12' is not required to provide power to one or more external devices but instead provides power only to the relay control circuit 18, the power supply 12' has a lesser electrical load such that the power supply 12' may be simplified. For example, the transformer 20' may have a significantly smaller current rating than a transformer 20 that must be capable of supplying current to. one or more external devices. Additionally, the voltage regulator 24' may be of a relatively more complex transistor form, or may be a relatively simplified transistor-less form using only a Zener diode that may also include filtering capacitors. Thus, the power supply 12' may be provided in a condensed size allowing the housing 2 or 2' to be smaller in size and allowing the overall apparatus contained within the housing 2 or 2' to be more cost efficient.

Figure 11:
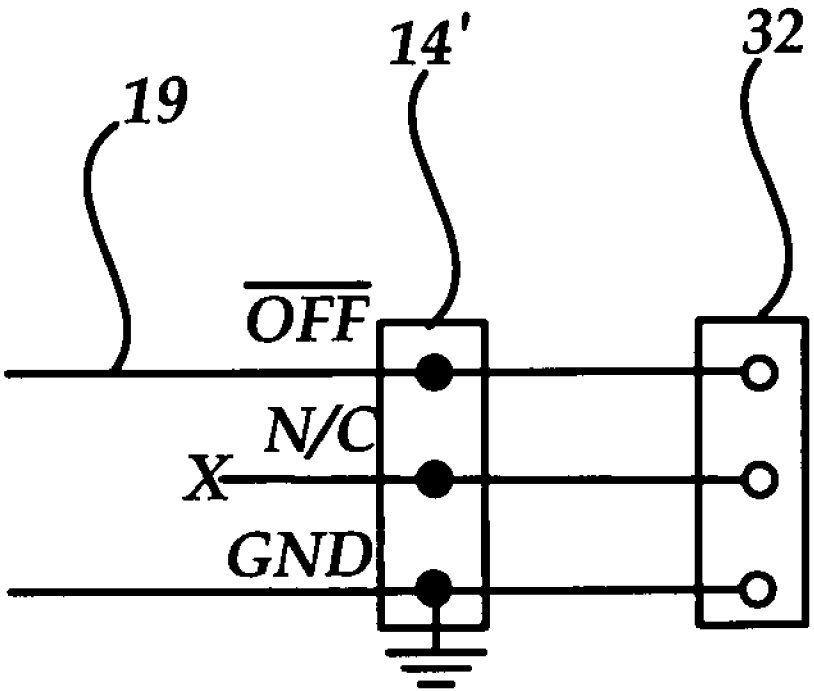
FIG. 11 is a circuit diagram illustrating a daisy chain connector provided by one embodiment of the present invention wherein power is not supplied to a second powered device.

Turning now to FIG. 11, a cable assembly and daisy chain connector utilized in various embodiments of the invention will be described. As shown in FIG. 11 and described briefly above, the input signal may be received from external devices through a cable assembly 10. The cable assembly 10 is terminated with a terminating connector 14' that includes a connector for ground and also includes a connector for the input signal 19 for controlling the relay control 18. In this manner, a cable assembly 10 can be utilized to expose the input signal 19 necessary for the external device to control the flow of power to the output connector 4 or 4'.

According to one embodiment of the invention, the housing 2 also includes a daisy chain connector 32. As shown in FIG. 11, the daisy chain connector 32 provides an input connector for ground and the input signal 19. The connectors of the daisy chain connector 32 are connected in parallel to the output connectors of the terminating connector 14', thereby creating a bus. Moreover, the daisy chain connector 32 is compatible with the terminating connector 14'. As shown and discussed above in relation to FIG. 7, multiple devices 2A–2N may be daisy chained together. A single external device connected to the daisy chain may then control the power delivered by each of the devices.

Based on the foregoing, it should be appreciated that embodiments of the invention provide an in-line remote controllable power switch with an integrated power supply. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An apparatus for providing power to one or more devices, the apparatus comprising:

a housing comprising an integrated power input connector for directly receiving a power cord;

an integrated power output cord connected in series to the integrated power input connector, the integrated power output cord configured to mate directly with a power input connector on a first powered device to provide alternating current to the first powered device;

a power supply mounted within the housing, the power supply connected in parallel to the power input connector and operative to generate direct current for delivery to at least a second powered device;

a cable assembly extending from the housing, the cable assembly connected to an output of the power supply and operative to deliver the direct current to the second powered device; and a control circuit mounted within the housing, the circuit operative to receive an input signal from the second device powered by the direct current of the power supply and, based on the input signal, to allow or prevent the flow of the alternating current to the integrated power output cord.

2. The apparatus of claim 1, wherein the cable assembly is terminated with a connector compatible with a power input on the second powered device.

3. The apparatus of claim 1, wherein the housing further includes a switch interposed between the integrated power input connector and the integrated power output cord, the switch operative to prevent the flow of the alternating current to the integrated power output cord when in an open position.

4. The apparatus of claim 3, wherein the switch is mounted on and accessible from an external portion of the housing.

5. The apparatus of claim 1, wherein the housing further includes a switch interposed between the integrated power input connector and the power supply, the switch operative to prevent the flow of current to the power supply when in an open position.

6. The apparatus of claim 5, wherein the switch is mounted on and accessible from an external portion of the housing.

7. The apparatus of claim 1, wherein the cable assembly comprises an electrical connection to the input signal.

8. The apparatus of claim 7, further comprising a parallel bus connector mounted on an external surface of the housing, the bus connector having electrical connections to the input signal and the power supply.

9. The apparatus of claim 8, wherein the bus connector is compatible with the terminating connector on the cable assembly.

10. The apparatus of claim 9, wherein the integrated power input connector comprises an IEC-320/C14 connector.

11. The apparatus of claim 10, wherein the integrated power output cord comprises an IEC-320/C13 connector.

12. An apparatus for providing power to one or more devices, the apparatus comprising:

a housing comprising an integrated power input connector for directly receiving a power cord and an integrated power output connector connected in series to the integrated power input connector, the integrated power output connector configured to mate directly with a power input connector on a first powered device to provide alternating current to the first powered device;

a power supply mounted within the housing, the power supply connected in parallel to the power input connector and operative to generate direct current for delivery to at least a second powered device;

a cable assembly extending from the housing, the cable assembly connected to an output of the power supply and operative to deliver the direct current to the second powered device; and a control circuit mounted within the housing, the circuit operative to receive an input signal from the second device powered by the direct current of the power supply and receive power from the power supply, and based on the input signal, to allow or prevent the flow of the alternating current to the integrated power output connector.

13. The apparatus of claim 12, further comprising a parallel bus connector mounted on an external surface of the housing, the bus connector having electrical connections to the input signal.

14. The apparatus of claim 13, wherein the bus connector is compatible with a terminating connector on the cable assembly.

15. The apparatus of claim 14, wherein the integrated power input connector comprises an IEC-320/C14 connector.

16. The apparatus of claim 15, wherein the integrated power output connector comprises an IEC-320/C13 connector.

17. An apparatus for providing power to one or more devices, the apparatus comprising:

a housing comprising an integrated power input connector for directly receiving a power cord;

a power output cord connected in series to the integrated power input connector, the power output cord configured to mate directly with a power input connector on a first powered device;

a power supply mounted within the housing, the power supply connected in parallel to the power input connector and operative to generate direct current for delivery to at least a second powered device; and a control circuit mounted within the housing, the circuit operative to receive an input signal having only a high or low value from the second device powered by the direct current of the power supply and receive power from the power supply, and based on whether the input signal has a high or low value, to allow or prevent the flow of alternating current to the integrated power output cord.

18. The apparatus of claim 17, further comprising a cable assembly extending from the housing, the cable assembly connected to an output of the power supply and operative to deliver the direct current to the second powered device.

19. The apparatus of claim 18, wherein the power output cord is integral with the housing.

20. The apparatus of claim 18, further comprising a parallel bus connector mounted on an external surface of the housing, the bus connector having electrical connections to the input signal.

21. The apparatus of claim 20, wherein the bus connector is compatible with a terminating connector on the cable assembly.

22. The apparatus of claim 21, wherein the integrated power input connector comprises an IEC-320/C14 connector.

23. The apparatus of claim 22, wherein the power output cord comprises an IEC-320/C13 connector.

* * * * *